United States Patent [19]

Glenn et al.

[11] Patent Number: 4,736,209

[45] Date of Patent: Apr. 5, 1988

[54] TENSIONABLE GROUND ELECTRODE FOR FLUID-JET MARKING APPARATUS

[75] Inventors: Michael I. Glenn, Burlington, N.C.; Bruce W. Halliday; Richard Sutera, both of Centerville, Ohio

[73] Assignee: Burlington, Industries, Inc., Greensboro, N.C.

[21] Appl. No.: 934,967

[22] Filed: Nov. 25, 1986

Related U.S. Application Data

[63] Continuation-in-part of Ser. No. 786,124, Oct. 10, 1985, Pat. No. 4,639,737, and a continuation-in-part of Ser. No. 732,278, May 9, 1985, Pat. No. 4,644,369.

[51] Int. Cl.[4] ..... G07D 15/18; B05B 5/00

[52] U.S. Cl. ..... 346/75; 239/690; 239/693; 239/708; 361/228

[58] Field of Search ..... 346/75, 140 R; 239/690, 239/693, 708; 361/228

[56] References Cited

U.S. PATENT DOCUMENTS

| | | | |
|---|---|---|---|
| 3,373,437 | 3/1968 | Sweet et al. | 346/75 |
| 3,560,988 | 2/1971 | Krick | 346/1.1 |
| 3,577,198 | 5/1971 | Beam | 346/75 |
| 3,579,721 | 5/1971 | Kaltenbach | 264/9 |
| 3,596,275 | 7/1971 | Sweet | 346/1.1 |
| 3,701,476 | 10/1972 | Houser | 239/102 |
| 3,701,998 | 10/1972 | Mathis | 346/75 |
| 3,739,393 | 6/1973 | Lyon et al. | 346/1.1 |
| 3,787,883 | 1/1974 | Cassill | 346/75 |
| 3,805,273 | 4/1974 | Brady et al. | 346/75 |
| 3,813,675 | 5/1974 | Steffy et al. | 346/75 |
| 3,836,913 | 9/1974 | Burnett et al. | 346/75 |
| 4,031,563 | 6/1977 | Paranjpe et al. | 346/75 |
| 4,081,804 | 3/1978 | Van Breemen et al. | 346/75 |
| 4,085,409 | 4/1978 | Paranjpe | 346/75 |
| 4,119,973 | 10/1978 | Stager | 346/75 |
| 4,229,748 | 10/1980 | Williams et al. | 346/75 |
| 4,234,884 | 11/1980 | Vedder | 346/75 |
| 4,245,226 | 1/1981 | Paranjpe et al. | 346/75 |
| 4,419,674 | 12/1983 | Bahl et al. | 346/75 |
| 4,538,157 | 8/1985 | Jones | 346/75 |

*Primary Examiner*—Clifford C. Shaw
*Assistant Examiner*—Gerald E. Preston
*Attorney, Agent, or Firm*—Nixon & Vanderhye

[57] ABSTRACT

An electrode for use in a fluid-jet marking apparatus includes a flexible and tensionable electrode member mounted in confronting, substantially parallel alignment to a linear array of fluid droplet streams. The mounting of the flexible and tensionable electrode member is accomplished by a pair of mounting arms in spaced-apart relationship, one of the arms being pivotal while the other arm is immovable. The one pivotal arm is thus displaced relative to the other immovable arm so as to responsively tension the electrode member therebetween.

In order to increase the vibrational frequency of the flexible and tensionable electrode member and/or to substantially decrease the vibrational amplitude thereof, at least one intermediate arm having a terminal end in operative contact with the electrode member is provided. The contact of the terminal end of the intermediate arm occurs at least one location along the electrode member between the pair of spaced-apart mounting arm members and thus essentially shortens the "free length" of the electrode member so that vibrational frequency of the electrode member is substantially increased thereby responsively substantially decreasing the vibrational amplitude of the electrode member towards and away from the droplet streams. In such a manner, the electrode member can be closely positioned laterally of the droplet streams.

An alternative embodiment of the electrode structure employs an additional flexible and tensionable ground electrode ("ground shield") preferably composed of a flexible ribbon of electrically conductive material disposed directly beneath the deflection electrode and in a substantially opposed confronting relationship to the droplet catching structure.

30 Claims, 7 Drawing Sheets

TENSIONABLE GROUND ELECTRODE FOR FLUID-JET MARKING APPARATUS

RELATED APPLICATIONS

This application is a continuation-in-part of application Ser. No. 786,124, filed Oct. 10, 1985 and a continuation-in-part of application Ser. No. 732,278, filed May 9, 1985, (now U.S. Pat. No. 4,639,737) entitled "Random Artificially Perturbed Liquid Jet (now U.S. Pat. No. 4,644,369)".

FIELD OF THE INVENTION

The present invention relates to the field of non-contact fluid marking devices which are commonly known as "ink-jet" or "fluid-jet" marking apparatus. More particularly, the present invention is directed to novel electrodes useful for charging and/or deflecting selected drops in a stream of droplets so as to selectively control the charging and/or deflection, respectively, of the droplets to effect marking upon a substrate.

BACKGROUND AND SUMMARY OF THE PRESENT INVENTION

Fluid-jet devices in and of themselves are well known through, e.g., U.S. Pat. Nos. 3,373,437 to Sweet et al, 3,560,988 to Krick; 3,579,721 to Kaltenbach; and 3,596,275 to Sweet. Typically, prior art fluid-jet devices provide a linear array of fluid-jet orifices formed in an orifice plate from which filaments or streams of pressurized marking fluid (e.g., ink, dye, etc.) are caused to issue from a fluid supply chamber. Individually controllable electrostatic charging electrodes are disposed downstream of the orifice plate along the so-called "drop-formation" zone. In accordance with known principles of electrostatic induction, each fluid filament is caused to assume an electrical potential opposite in polarity and related in magnitude to the electrical potential of its respective charging electrode. When a droplet of fluid is separated from the filament, this induced electrostatic potential is then trapped on and in the droplet in the form of an electrical charge. Thus, subsequent passage of the charged droplet through an electrostatic field will cause the droplet to be deflected towards a catching structure. Uncharged droplets on the other hand proceed along the normal droplet flight path and are eventually deposited upon a recording substrate.

Recently it has been proposed to utilize fluid-jet apparatus as a means to print patterns or the like on textile materials, attention being directed to commonly-owned U.S. Pat. No. 4,523,202 which is expressly incorporated herein by reference. In order to achieve fine printing of patterns on a textile substrate, it is necessary to utilize an orifice plate having at least one linear array of very small orifices sized in the range of, for example, 0.00035 to 0.020 inch diameters. As can be appreciated, such small-sized orifices will establish correspondingly small-sized droplets and thus it is necessary in order to achieve selective control over the charging and/or deflection of such droplets to place the charge and deflection electrodes as closely adjacent to the droplet streams as is structurally possible.

A problem exists, however, that during operation of the fluid-jet apparatus, structural vibrations may occur and will be evidenced by periodic vibrational displacements of the electrodes towards and away from the droplet streams. Thus, as a practical matter, the electrodes in a fluid-jet apparatus cannot be placed as closely adjacent to the fluid droplet stream as would otherwise be desired since some space must be provided between the electrode face and the droplet stream so as to compensate for the amplitude of the electrode vibration towards and away from the droplet streams. Should the electrode be placed too close to the droplet stream without providing such a compensating space, the electrode during vibration may contact the fluid droplet streams, thereby wetting the electrode surface. Such an occurrence is clearly undesirable since the charge and/or deflection functions of the electrodes would be disturbed due to short-circuiting of the electrodes by virtue of their wetted surfaces thereby deleteriously affecting charge and/or deflection control of the fluid droplets in the streams which, in turn, disadvantageously affects the resulting print quality on the substrate. It is towards a solution to the above-described problems that one embodiment of the present invention is directed.

The electrode structure of the present invention is preferably a flexible ribbon of an electrically-conductive material (e.g., stainless steel) which is tensioned between a pair of support arms so as to be laterally positionable substantially parallel to the linear array of fluid droplet streams issuing from the orifice plate. One surface of the electrode will thus be in confronting relationship to the droplet streams so as to charge droplets or deflect already charged droplets in the streams depending upon whether the electrode is used as a charge electrode or a deflection electrode, respectively.

In order to permit close mounting of the electrode in confronting relationship to the fluid droplet streams, one of the support arms is rigidly fixed (i.e., immovable) while a second support arm is pivotally mounted so as to be displaceable relative to the other, rigid support arm. A tensioning structure, (preferably including a force-adjustable compression spring) is operatively connected to the pivotal second support arm so as to cause pivotal displacement relative to the rigid support arm to maintain the flexible electrode under tension therebetween. The tensioning structure also serves to compensate for relaxation of the electrode (e.g., due to thermal expansion) and thus maintains the electrode under substantially constant tension between the pair of support arms.

Thus, the pivotal mounting of the second support arm of the present invention promotes laterally adjacent placment of the electrode in confronting relationship to the droplet streams. The pivotal second support arm also acts as a lever of sorts with the compression spring acting as its fulcrum so as to provide greater ease in tensioning of the electrode. These advantages are important for large cross-machine widths which the electrodes of the present invention must span so as to effectively operate as a component part of a fluid-jet apparatus for printing upon textile substrates, for example.

An alternative embodiment of the present invention employs an additional flexible and tensionable ground electrode or "ground shield" (preferably composed of a flexible ribbon or wire of electrically conductive material) mounted directly beneath the deflection electrode and in a substantially confronting relationship to the droplet catching structure.

Recently, it has been found that the use of this additional ground electrode solves a problem which occurs with electrodes used in fluid jet marking apparatus of the type having separate means for electrostatically charging and deflecting the fluid droplets. In particular, certain of the selectively charged droplets passing through the deflection field, i.e., droplets which normally are caught by the droplet catching structure and do not impact on the substrate, may not be deflected toward the catching structure to the extent necessary to impact on the droplet catcher face. In addition, certain of the charged droplets may be deflected into divergent or even fluctuating flight paths which could cause the droplets to miss the catcher entirely and fall to the substrate, thereby adversely effecting the desired printed pattern. On occasion, it has also been observed that certain stray droplets may be forced upwardly from the droplet deflection zone and may accumulate on the deflection and charging electrodes, thereby adversely affecting their performance.

The alternative embodiment of the electrode structure in accordance with the present invention solves the above problems relating to stray or divergent fluid droplets by providing an additional ground electrode or "ground shield" which is positioned substantially parallel to the droplet streams issuing from the orifice plate and directly below the deflection electrode.

The ground electrode is also positioned in substantially confronting alignment with the droplet catching structure. In that position, it serves to eliminate the problems resulting from stray or mis-deflected droplets by ensuring that the droplets are diverted toward the droplet catching surface and are thus caught by the catcher structure. In that regard, it is believed that the ground electrode serves to "stabilize" the deflection field along the fluid droplet path in the area below the deflection electrode but above the fluid droplet catcher. Thus, it has been found that the ground electrode should preferably be laterally aligned directly beneath the deflection field on the opposite side of the catcher face with a preferred vertical separation distance between the ground and deflection electrodes of between ¼" and 1".

The ground electrode or "ground shield" according to the present invention is initially mounted and tensioned between the same pair of mounting arms used to laterally position and tension the deflection electrode. However, once in position, the ground electrode may be further adjusted and tensioned using a separate tension assembly operatively coupled to the common support structure for the deflection and ground electrodes. Thus, if desired, the ground shield may be selectively adjusted to a slightly different tensioned state from that of the deflection electrode.

A further embodiment of the tension assembly for the mounting arms for electrode structures in accordance with the present invention is also disclosed in which the charge, deflection and ground electrodes are tensioned using selectively adjustable tension assemblies in which a bias force is exerted laterally on one of two mounting arms to thereby maintain each electrode in a tensioned state without danger of displacement or misalignment of the electrodes during the mounting operation.

With respect to the charging and deflection electrodes, the present invention also provides for a structure which contacts the electrode at at least one position along its axial length between the pair of support arms so as to substantially increase the electrode's vibrational frequency and/or to substantially decrease the electrode's vibrational amplitude. This aspect of the present invention apparently effectively shortens the so-called "free length" of the electrode so that the electrode will exhibit the highest possible frequency of vibration and thus a corresponding decrease of the amplitude of vibration towards and away from the fluid droplet streams. By shortening the free length of the electrode, the structure of the present invention apparently effectively increases the fundamental frequency of vibration of the electrode (with a resulting decrease in the electrode's vibrational amplitude) thereby allowing closer placement of the electrode to the droplet streams than would otherwise be possible without the structure of the present invention. That is, if it is assumed that vibration of the electrode in a plane parallel to the droplet streams is negligible, then the fundamental frequency of the electrode in a plane perpendicular to the droplet streams can be expressed by:

$$f = \frac{1}{2l} \frac{F}{\mu}$$

where f is the fundamental frequency (cycles/sec), is the free length of the electrode (in.), F is the tension applied to the electrode (lbs.-force), and $\mu$ is the mass per unit length of the electrode (lbs.-sec$^2$/in.). Accordingly, by decreasing the free length of the electrode, the fundamental frequency is increased thereby decreasing the amplitude of the electrode's vibration towards and away from the droplet streams.

Such frequency increasing/amplitude decreasing functions are provided according to an aspect of this invention by means of at least one intermediate arm having a terminal end which contacts a portion of the charging and/or deflection electrode along its axial length between the pair of support arms when the electrode is in its tensioned state. The contact between the terminal end of the intermediate arm on the one hand and the portion of the electrode on the other hand apparently establishes a vibration node and thus shortens the "free length" of the electrode by establishing at least a pair of sublengths of the electrode between the intermediate arm and each lateral support arm.

This increase of vibrational frequency which is accomplished by the intermediate arm structures of this invention is directly contrary to "damping" structures typically provided with conventional electrode assemblies. That is, conventional electrode assemblies decrease or damp the vibrational frequency of the electrode over time as an attempt to permit closer placement of the electrode to the droplet stream. The present invention seeks just the opposite result in that an increased frequency (and thus decreased amplitude) is achieved by provision of the intermediate arm structures as briefly mentioned above.

BRIEF DESCRIPTION OF THE ACCOMPANYING DRAWINGS

Reference will be hereinafter made to the accompanying drawings wherein like reference numerals throughout the various figures denote like structural elements and wherein:

FIG. 1 is a schematic elevational view of a fluid-jet marking apparatus in which the electrode structures of the present invention are particularly well suited for use;

FIG. 1*a* is a schematic representation of a variation of the fluid-jet marking apparatus shown in FIG. 1 in which the electrode structures of this invention may also be used;

DETAILED DESCRIPTION OF THE PREFERRED EXEMPLARY EMBODIMENT

Figure 1:
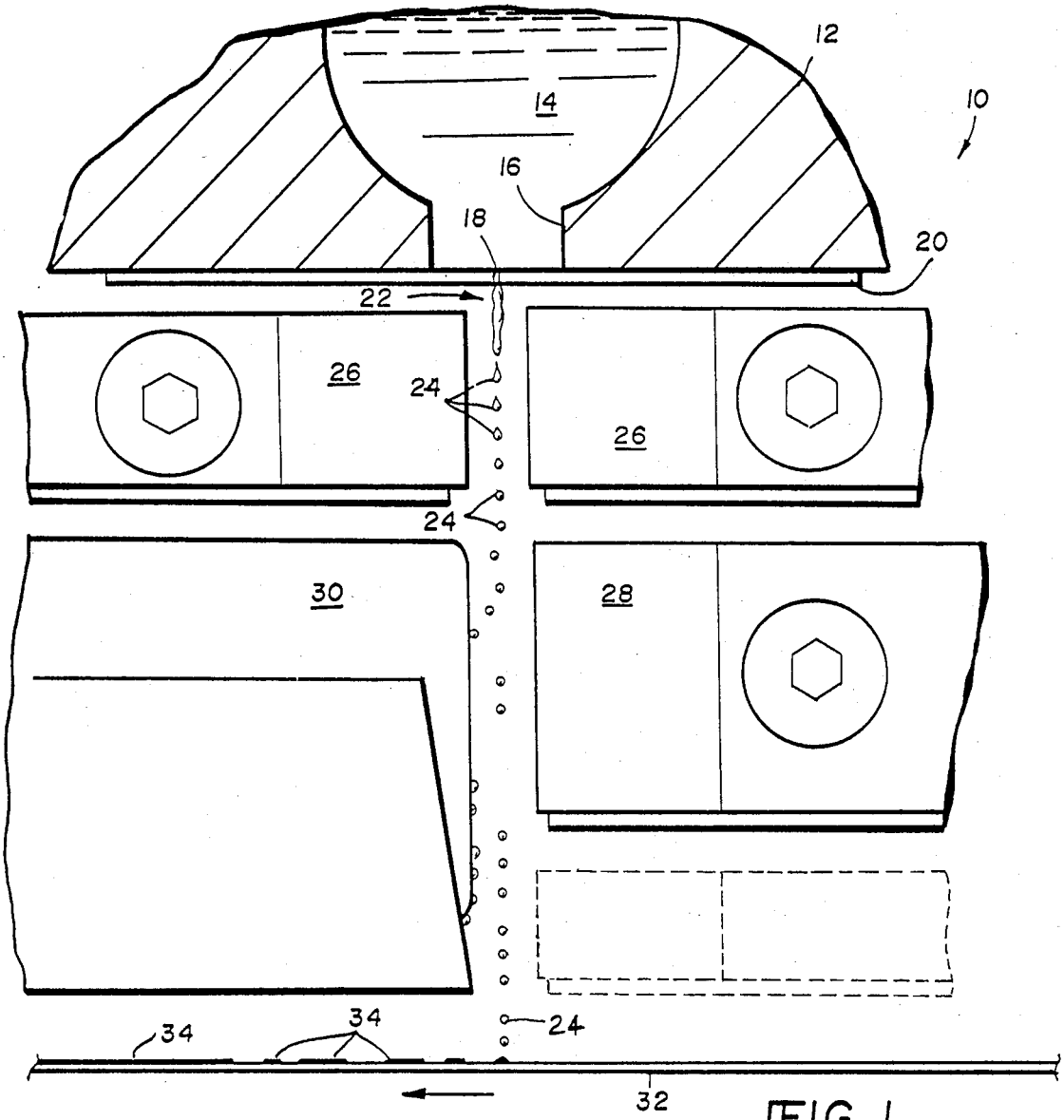

A fluid-jet marking apparatus 10 in which the present invention finds particular utility is shown in accompanying FIG. 1, the structures thereof being shown in a greatly-enlarged manner for clarity of presentation. The fluid-jet apparatus 10 generally includes a manifold assembly 12 which defines a fluid supply chamber 14. The lower end of supply chamber 14 establishes an outlet slot 16 so that fluid can pass through a linear array of orifices 18 defined in orifice plate 20. Thus, fluid filament 22 issuing from each orifice 18 is capable of forming individual droplets 24 in the droplet formation zone adjacent charge electrodes 26. During droplet formation, an electrostatic charge is placed upon selected ones of droplets 24 by means of charge electrodes 26. Charged ones of droplets 24 are then deflected by deflection electrode 28 towards catching structure 30 while uncharged ones of droplets 24 proceed on to substrate 32 so as to be deposited thereon and form indicia, patterns, solid shade coloring or the like generally represented by numeral 34.

It should be understood that the desired end result of the fluid marking upon substrate 32 will determine whether the electrode of this invention is used as both a charging electrode and a deflection electrode or whether it is used as only one of the charging and deflection electrodes. Thus, the apparatus 10 is shown in FIG. 1 as employing the electrodes of this invention as both the charging electrodes 26 and the deflection electrode 28. FIG. 1 also depicts (in figurative dotted-line form) the alternative embodiment of electrode structures according to the invention employing the additional ground electrode.

Apparatus 10 of FIG. 1 is therefore particularly well suited for the "printing" of a uniformly applied marking fluid (i.e., "solid shade" coloring) upon substrate 32 in accordance with the techniques disclosed, for example, in commonly-owned and co-pending U.S. application Ser. No. 729,412 filed on May 1, 1985 in the name of Dressler et al. On the other hand, if geometric or fanciful patterns, indicia or the like are desired to be printed upon substrate 32 (i.e., "pattern printing"), then the charge electrode may take the form of an array of plural electrodes extending in the cross-machine direction (see, for example, the electrode disclosed in commonly-owned and copending U.S. application Ser. No. 736,076 filed May 20, 1985 in the name of Sutera et al), so as to more or less effect independent charge control upon the individual fluid droplet streams in which case the electrode of this invention is preferably utilized as the deflection electrode.

Figure 1A:
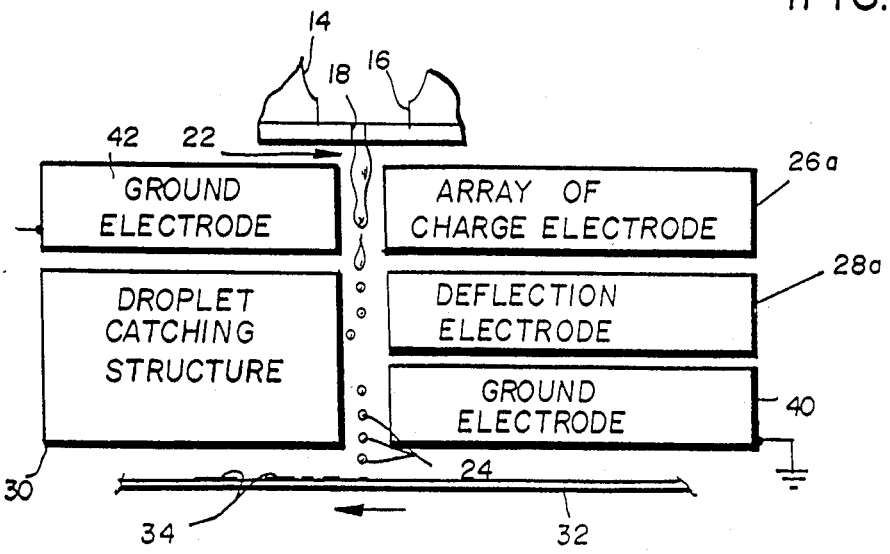

FIG. 1*a* schematically depicts a fluid-jet marking apparatus 10*a* having an array of charge electrodes 26*a* and a deflection electrode 28*a*, the latter being an electrode in accordance with this invention. All other principal structures of apparatus 10*a* (e.g., droplet catching structure 30, orifice plate 18, etc.) can be identical to those structures referenced above with respect to apparatus 10. However, when the electrode structure of this invention is used as the deflection electrode 28*a* for the pattern printing of substrate 32, it is also preferably to employ a ground electrode or "ground shield" 40 therebeneath in addition to employing ground electrode 42 (also preferably in accordance with the electrode structures of this invention) opposing the charge electrode array 26*a* as can be seen schematically in FIG. 1*a*.

Figure 2:
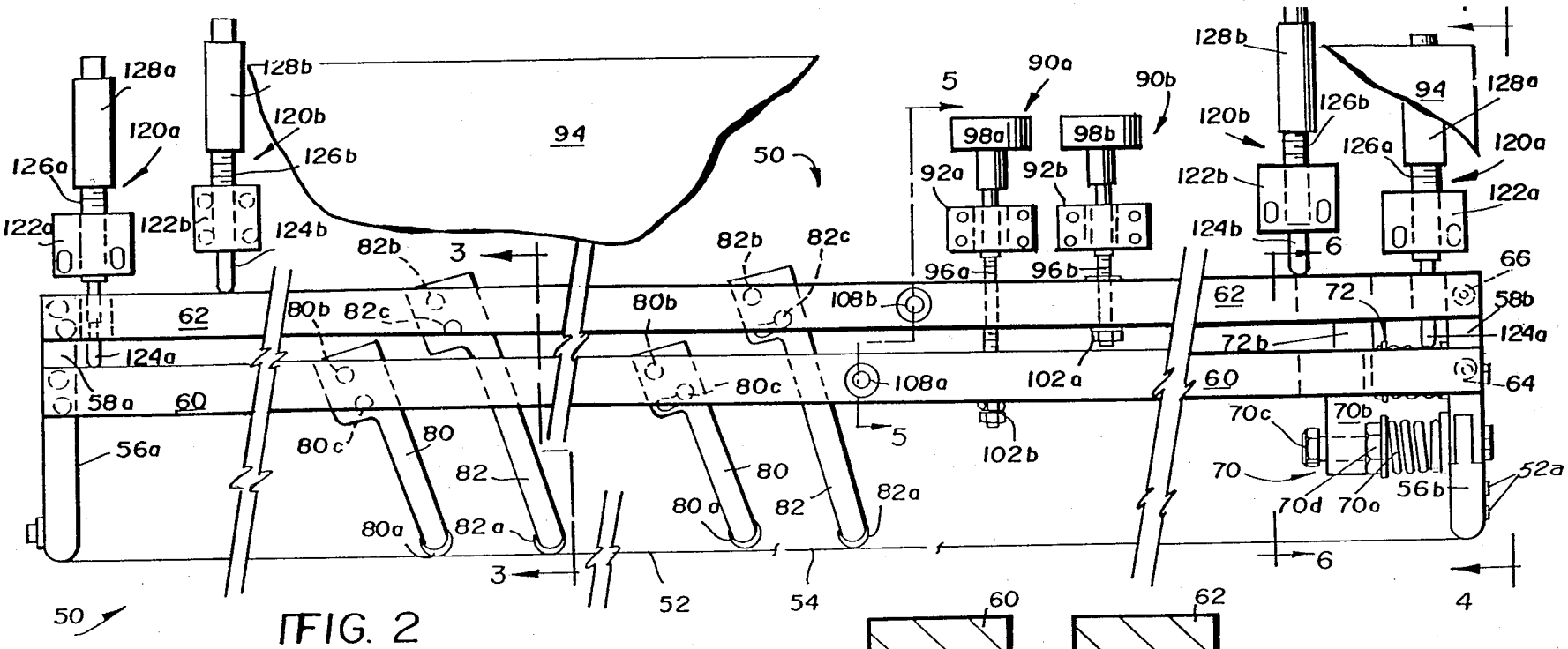
FIG. 2 is a top plan view of the electrode structures of the present invention.
Figure 3:
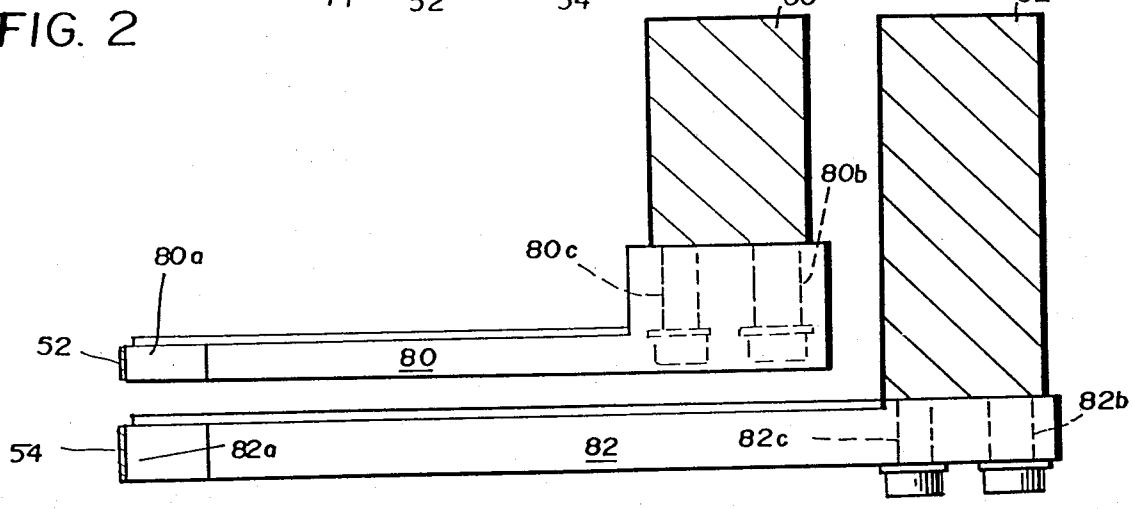
FIG. 3 is a cross-sectional elevational view of the intermediate arms of the present invention taken along line 3—3 in FIG. 2.
Figure 4:
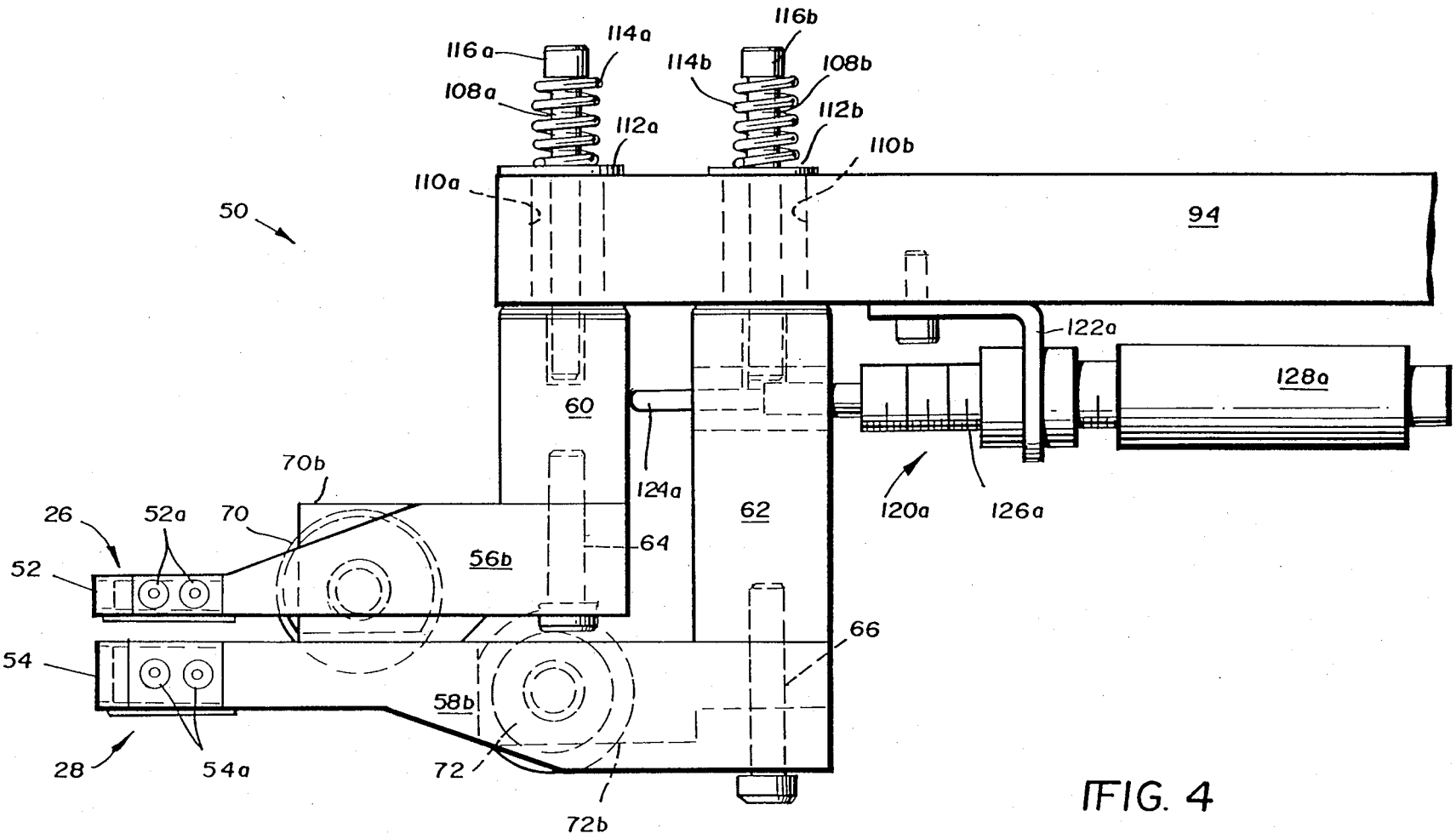
FIG. 4 is a side elevational view of the electrode structures of the present invention as viewed from line 4—4 in FIG. 2.

The electrode assembly 50 employing electrode structure of the present invention in a capacity as both the charge electrodes 26 and deflection electrode 28 will be better understood by reference to accompanying FIGS. 2–4 and the description thereof which follows. Although reference will be made to the electrode assembly 50 as comprising both one of the charge electrodes 26 and a deflection electrode 28 each in accordance with this invention, it is contemplated that the structural features of the present invention could be embodied in the fluid jet apparatus 10 as either a charge or a deflection electrode alone in dependence upon the desired printing result upon substrate 32 as was briefly mentioned above. Moreover, since the structural features of this invention relating to charge electrodes 26 are functionally similar to the structural features of deflection electrode 28, only those structures relating to charge electrodes 26 will be described below. Wherever possible, those structures of deflection electrodes 28 will, however, be parenthetically noted along with those structures of charge electrodes 26 to which they correspond. It should also be understood that both charge electrodes 26 shown in FIG. 1 are identical to (but mirror images of) one another and thus only the charge electrode 26 which is associated with deflection electrode 28 via assembly 50 will be described in detail below.

As is shown in FIGS. 2–4, charge electrode 26 (28) includes a flexible and tensionable electrode member 52 (54) tensioned between a pair of mounting arms 56*a*, 56*b* (58*a*, 58*b*). The arms 56*a*, 56*b* (58*a*, 58*b*) are themselves mounted to cross-support member 60 (62) so that the arms 56*a*, 56*b* (58*a*, 58*b*) are maintained in spaced relationship relative to one another. Arm 56*a* (58*a*) is rigidly connected to cross-support member 60 (62) so as to be immovable relative thereto while arm 56*b* (58*b*) is pivotally connected to cross-support member 60 (62) by mean of pivot pin assembly 64 (66).

Tension assembly 70 (72) is operatively coupled to cross-support 60 (62) and is shown in greater detail in FIG. 2. Tension assembly 70 (72) includes a compression spring 70a exerting a bias force between arm 56b and subsupport 70b (72b). An adjusting bolt 70c (72c) and nut 70d are threadably engaged with one another and permit the bias force exerted upon arm 56b to be selectively adjustable in dependence upon selective turning movement being applied to bolt 70c (72c). Accordingly, the bias force exerted upon arm 56b by compression spring 70a forcibly urges arm 56b to be pivotally moved outwardly away from its opposing rigidly-fixed arm 56a thereby maintaining the ribbon electrode member 52 in a tensioned state between the two arms 56a, 56b. It should be understood that the ribbon electrode 54 is maintained in a tensioned state between arms 58a, 58b by means of tension assembly 72 in a like manner to that of tension assembly 70 even though its corresponding structure is not entirely shown in detail in the accompanying Figures. Thus, the tension assembly 70 (72) maintains ribbon electrode member 52 (54) in a tensioned state between arm pairs 56a, 56b (58a, 58b) while automatically compensating for e.g., thermal relaxation of ribbon electrode member 52 (54) which may occur during usage by virtue of the outward biased displacement of pivotally mounted arm member 56b (58b) relative to its opposing immovably fixed arm 56a (58a).

Cross-support member 60 (62) includes intermediate arms 80 (82) pivotally mounted thereto. Each intermediate arm 80 (82) includes a terminal end 80a (82a) which is in operative contact with ribbon electrode member 52 (54). The intermediate arms 80 (82) are pivotally mounted to cross-support member 60 (62) by conventional bolts, pivot pins or the like generally shown by reference numeral 80b (82b). To positionally maintain the intermediate arms 89 (82) in contact with ribbon electrode member 52 (54), there is respectively provided a slot and locking bolt assembly 80c (82c) as can be seen in FIG. 2. Once intermediate arms 80 (82) have been pivotally moved so as to be in operative contact with ribbon electrode member 52 (54), the bolts 80c (82c) are tightened thereby maintaining the terminal ends 80a (82a) of arms 80, (82) in contact with electrode member 52 (54).

According to this invention at least one intermediate arm 80 (82) is provided so as to effectively shorten the "free length" of the ribbon electrode 52 (54)—that is, to establish at least first and second sublengths of ribbon electrode 52 (54) between the contact of the terminal end 80a (82a) and each of the mounting arms 56a, 56b (58a, 58b). When the electrode member 52 (54) is utilized in the printing of textile substrates, it must span the cross-machine width of the textile substrate (typically about 1.8 meters) and thus, under such circumstances, it is desirable to utilize plural intermediate arms 80 (82) as is shown in the accompanying drawings. It will be understood that when N arms 80 (82) are utilized, N+1 sublengths of ribbon electrode 52 (54) are established between adjacent ones of intermediate arms 80 (82) and between the outermost ones of intermediate arms 80 (82) and a respective one of mounting arms 56a, 56b (58a, 58b). It is preferred that the axial length dimensions of the sublengths be unequal relative to one another to more effectively prevent vibration of one sublength affecting vibration of an adjacent sublength or sublengths.

The mounting arms 56a, 56b and 58a, 58b and intermediate arms 80, 82 are each preferably formed entirely from a substantially rigid electrically-insulating material (e.g., nylon) so as to not only electrically isolate electrode member 52 and electrode member 54 from one another but also to electrically isolate each electrode member 52 and 54 from the other metal structural members comprising assembly 50. The electrode members 52, 54 can thus be connected to appropriate voltage drive sources (not shown) by means well known to those in the electrical arts, for example, by connecting leads from the appropriate voltage drive sources to mounting screws 52a and 54a, respectively.

Figure 5:
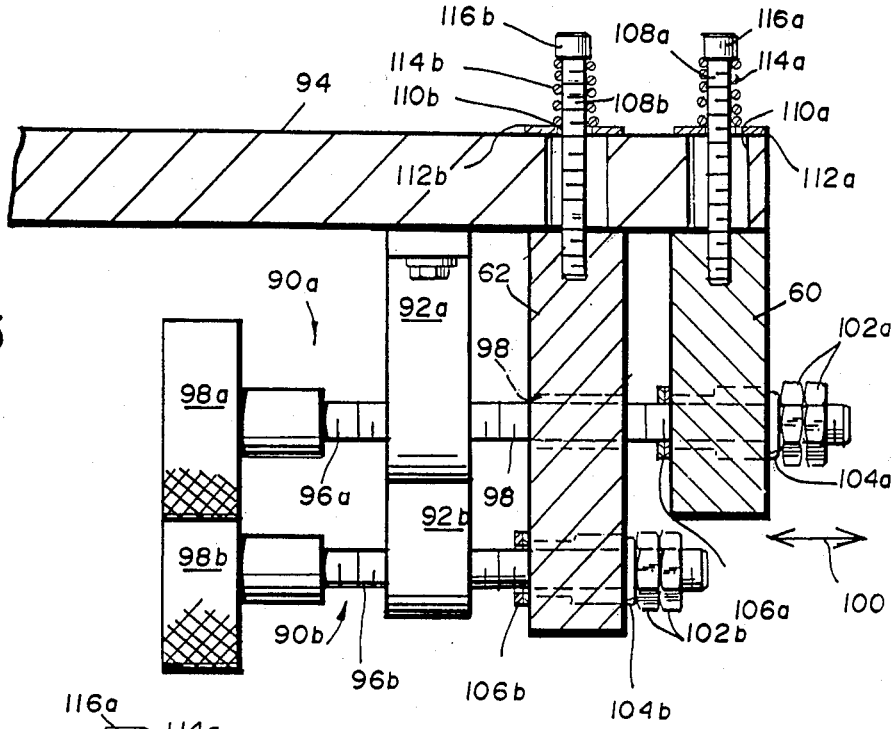
FIG. 5 is a cross-sectional elevational view taken along line 5—5 in FIG. 2 of the adjusting mechanisms of the present invention.
Figure 6:
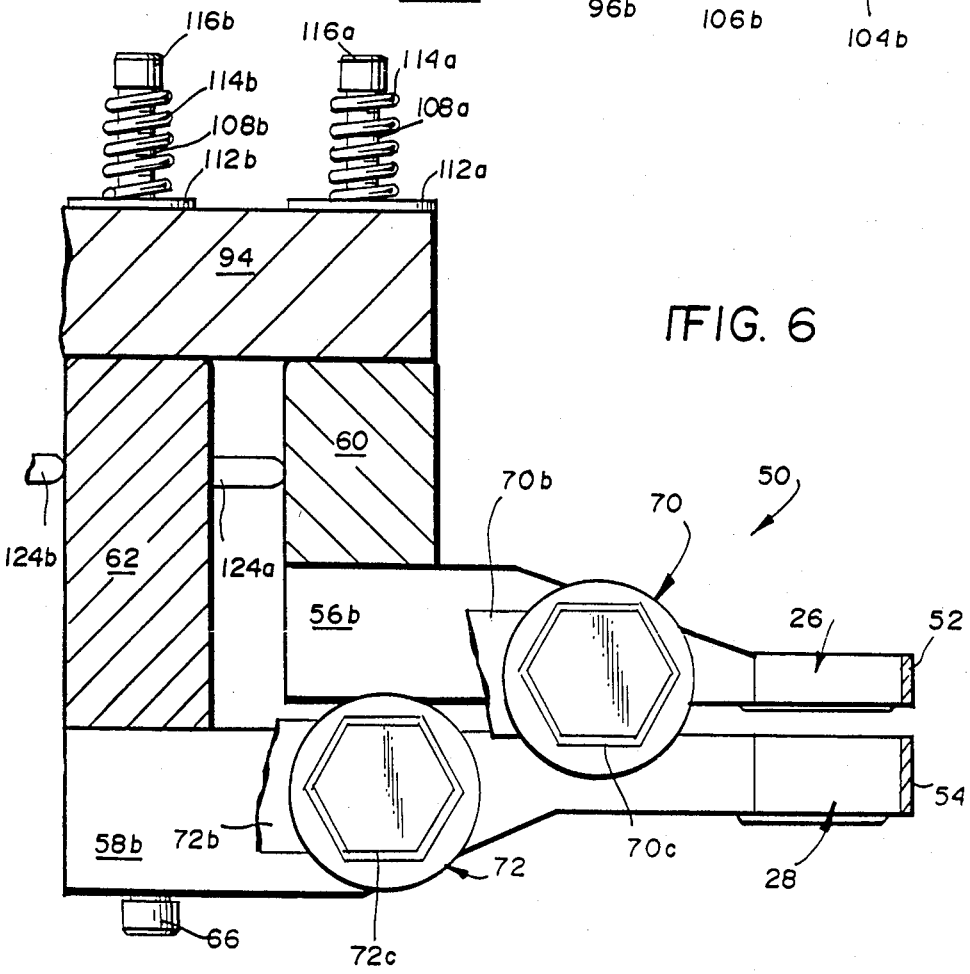
FIG. 6 is an interior elevational view taken along line 6—6 in FIG. 2 of the pivotal support arms of the mounting structures of the present invention.

Lateral positioning of electrode member 52 (54) relative to the droplet streams is accomplished according to this invention by means of a lateral adjustment assembly 90a (90b) operatively coupled to cross-support member 60 (62) as can be seen with greater clarity in FIG. 5. Adjustment assembly 90a (92b) includes a mounting bracket 92a (92b) fixed to the upper support member 94. A threaded adjustment shaft 96a (96b) is threadably coupled to bracket 92a (92b) and includes a knurled knob 98a (98b) at a rearward end thereof so that adjusting shaft 96a (96b) can be turned manually to effect displacement forwardly and rearwardly (arrow 100) of shaft 96a (96b) relative to bracket 92a (92b). The forward end of shaft 96a (6b) is coupled to cross-support 60 (62) by means of locknuts 102a (012b) and compression spring 104a (104b), the latter being biasingly compressed between locknuts 102a (014a) on the one hand and cross-support member 60 (62) on the other hand. A lock waster 106a (106b) is also provided on the rearward side of cross-support member 60 (62). The shaft 96a slidably passes through aperture 98 defined in cross-support 62 so that turning movement cf shaft 96a will not affect cross-support 62.

Cross-support member 60 (62) is itself coupled to frame support so as to permit movement forwardly and rearwardly relative to the droplet stream (arrow 100). To accomplish this, a bolt 108a (108b) is threadably coupled to cross-support member 60 (62) and is slidably received within slot 110a (110b) defined in frame support 94. A washer 112a (112b) provides a bearing surface against which the bias force of compression spring 114a (114b) can be exerted, the compression spring 114a (114b) being disposed between head 116a (116b) of bolt 108a (108b) and washer 112a (112b). Accordingly, bolts 108a (108b) can be slightly loosened to permit slidable movement of cross-support member 60 (62) relative to frame support 94 in the direction of arrow 100 in response to turning movement being manually applied to knob 98a (98b). In such a manner, cross-support member 60 (62) is selectively moved forwardly or rearwardly relative to the droplet streams also in the direction of arrow 100. Preferably, a plurality of the bolt/-spring assemblies 108a/110a (108b/110b) are disposed axially along the length of cross-support member 60 (62)

A pair of calibrators 120a (120b) are preferably provided in operative contact with cross-support member 60 as can be seen more clearly in FIG. 2. Calibrator 120a (120b) (see FIG. 4) is fixed to frame support 94 by means of L-shaped bracket 122a (122b) so that calibrator 120a (120b) is disposed rearwardly of cross-support member 60 (62). Calibrator 120a (120b) includes a feeler arm 124a (124b) in contact with cross-support member 60 (62) and a vernier scale 126a (126b). A biasing spring (not shown housed within cylinder 128a (128b) biases vernier scale 126a and thus feeler arm 124a (124b) so as to maintain contact between cross-support member 60 (62) and feeler arm 124a (124b). As such, when lateral adjustment of cross-support member 60 (62) is effected by means of turning movement being applied to knob 98a (8b), the amount of movement can be visually determined by reference to vernier scale 126a (126b) in contact with cross-support member 60 (62). Correct alignment and placement of electrode member 52 (54) relative to the droplet stream is thereby insured. Once the correct positioning and alignment of electrode member 52 (54) is achieved, bolts 108a (108b) are threadably tightened so as to maintain cross-support member 60 (62) in its properly aligned position.

Figure 7:
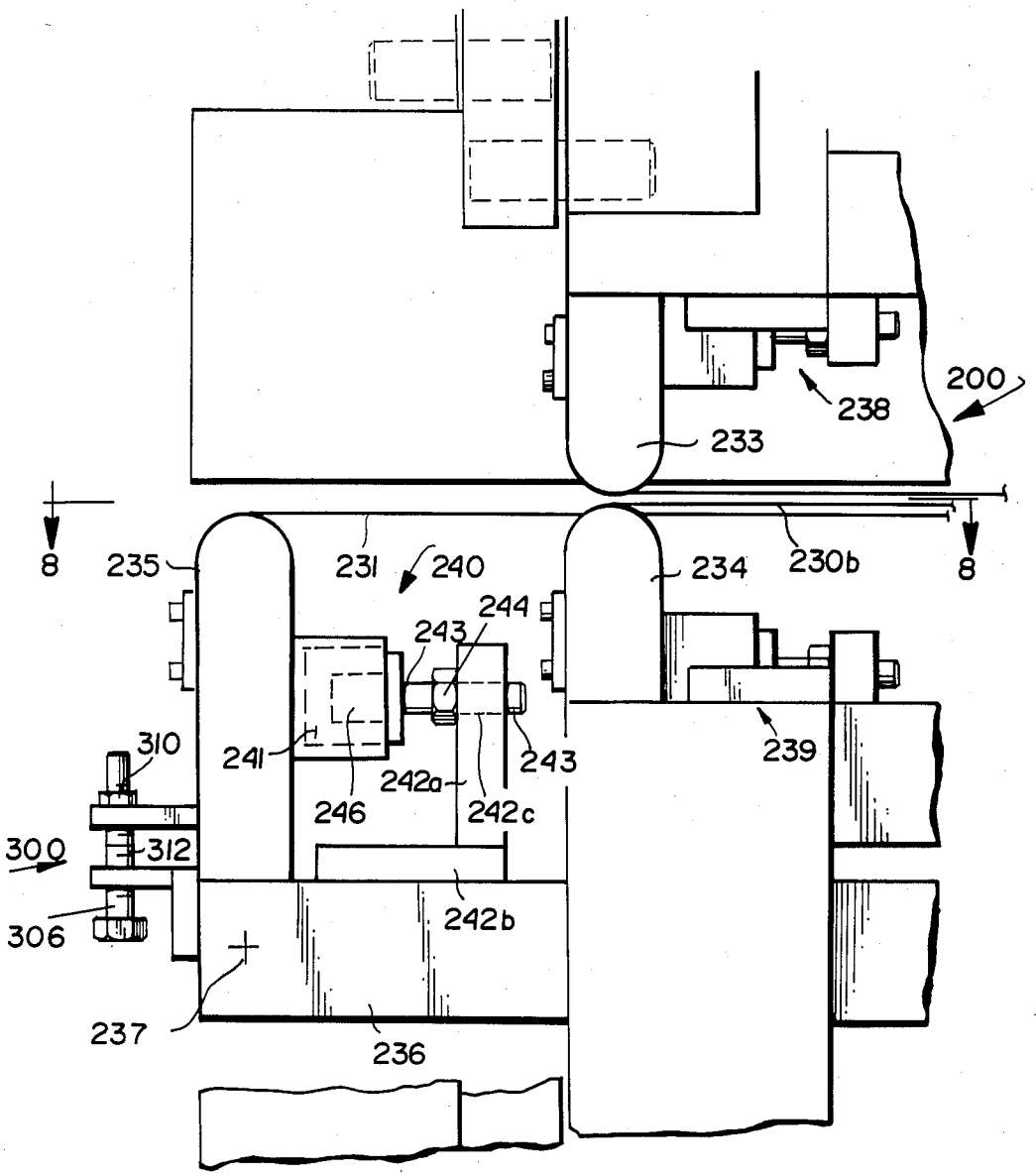
FIG. 7 is a top plan view of an alternative embodiment of the electrode structure of the present invention.
Figure 8:
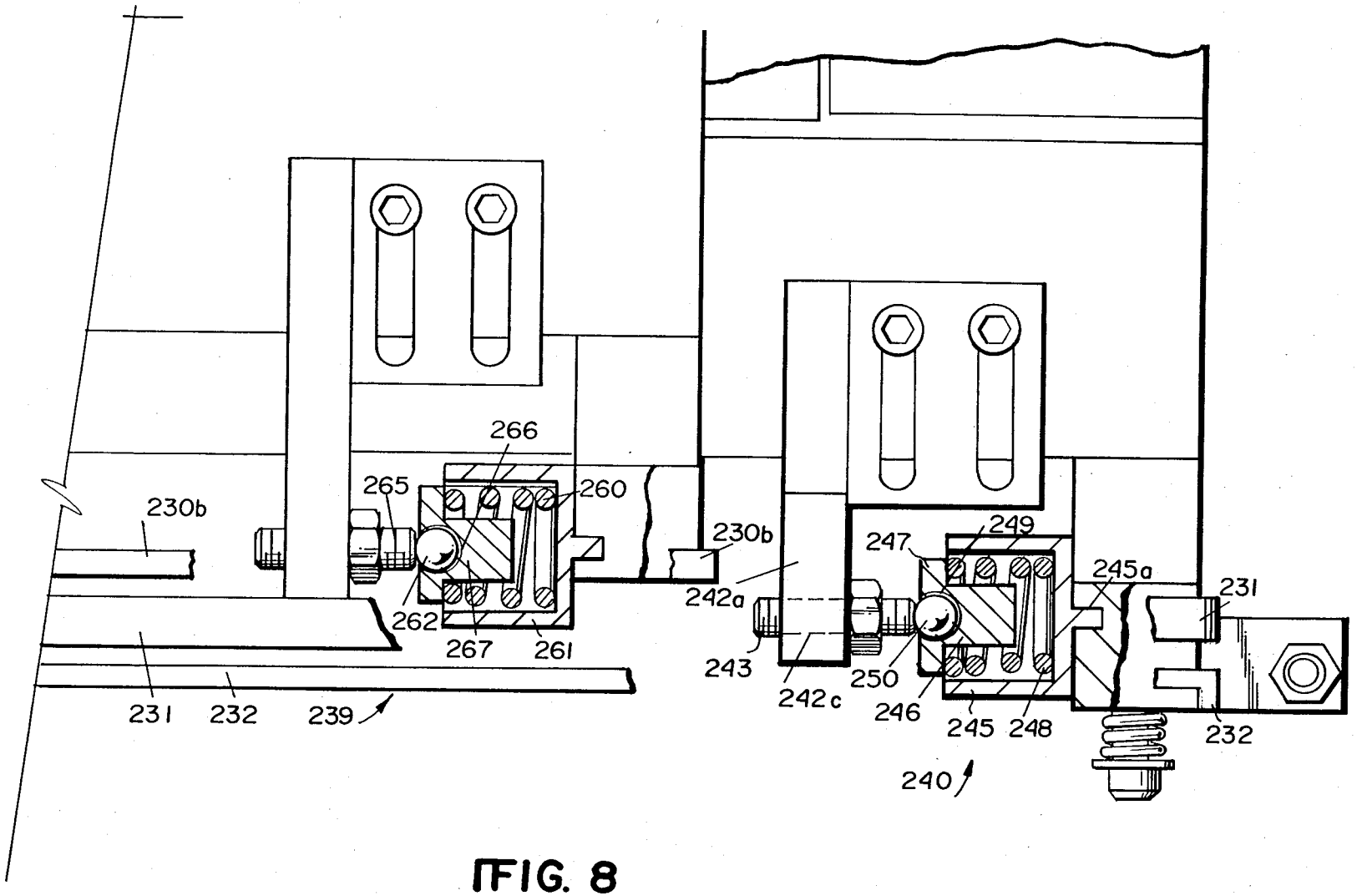
FIG. 8 is a cross-sectional elevational view taken along line 8—8 of FIG. 7 of an alternative embodiment of an exemplary tension adjusting assembly in accordance with the present invention.
Figure 9:
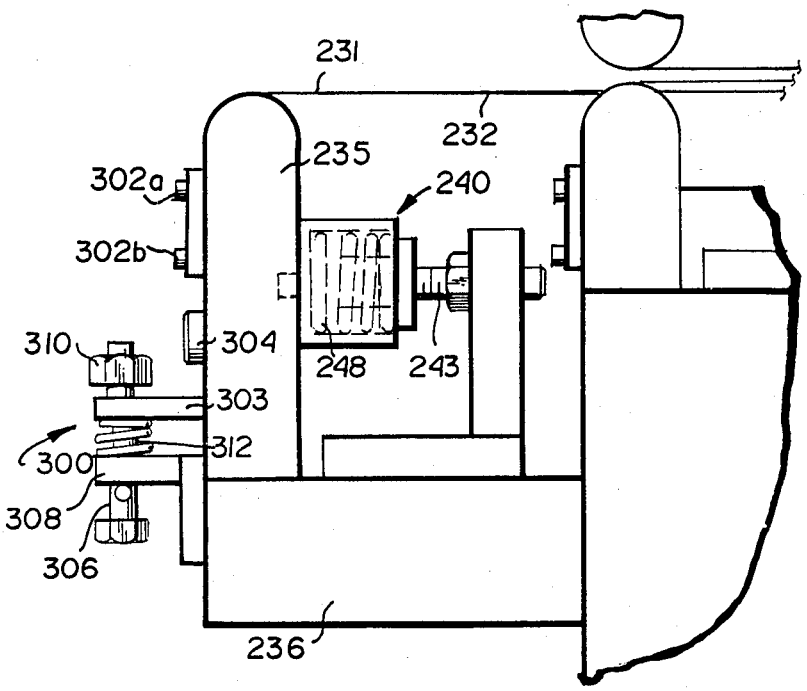
FIG. 9 is a top, plan view of a separate tension assembly for the ground electrode employed in electrode structures according to the present invention.

An alternative embodiment of the electrode structure in accordance with the present invention, including the associated mounting and tension assemblies, is depicted in FIGS. 7, 8 and 9 of the drawings, the structures thereof also being shown in a greatly-enlarged manner for clarity of presentation. With particular reference to FIG. 7, the electrode assembly (shown generally as 200) employs two charging electrodes 230a and 230b, respectively, disposed substantially parallel to the array of orifices and in a lateral confronting relationship to one another. The electrode structure of FIG. 7 also includes deflection electrode 231 which is mounted below the laterally opposing charge electrodes and a separate ground electrode or "ground shield" see item 232 on FIGS. 8, 9 and 10). The ground shield is laterally positioned directly below deflection electrode 231, preferably at a distance of between ¼" and 1" and in a substantially opposing confronting relationship to the droplet catching structure as seen schematically in FIGS. 1 and 1a. Preferably, the tensionable ground shield electrode is composed of a flexible ribbon of electrically conductive material. For certain "pattern printing" applications, however, it has been found that the ground electrode may also consist of an electrically conductive wire.

FIG. 7 also shows the specific orientation of the tensionable (pivotably-movable) mounting arm assemblies 233 and 234 for the two charge electrodes, as well as the tensionable, pivotably-movable mounting arm 235 for the deflection and ground shield electrodes. Unlike the previous embodiment, however, mounting arm 235 may be used to mount and initially tension both deflection electrode 231 and ground shield electrode 232 during the same selective adjustment of the tension assembly. The mounting assemblies for the charge, deflection and ground electrodes are functionally and structurally similar to the features described above. In addition, both charge electrodes 230a and 230b shown in FIG. 7 are identical in structure (but mirror images of one another).

Both deflection electrode 231 and ground electrode 232 are laterally mounted (as described in greater detail with respect to FIG. 10) between the same pair of opposing mounting arms which in turn are mounted to cross support member 236 on FIG. 7. Thus, the electrodes are maintained in a vertical spaced relationship to one another, with ground electrode 232 being laterally positioned directly below deflection electrode 231 with a prescribed separation distance between the bottom edge of the deflection electrode and the top edge of the ground electrode in the range of ¼" to 1". The ground electrode is thus secured to each of the mounting arms at a point below the deflection electrode and, once in position, remains in a substantially confronting alignment with the droplet catching structure. One of the mounting arms for mounting the deflection and ground shield electrodes (not shown) is rigidly connected to cross support member 236 so as to be immovable relative thereto while mounting arm 235 is pivotally connected to cross support member 236 by means of a pivot assembly 237 which is functionally and structurally similar to the mounting arm pivot assemblies described above.

FIG. 7 shows tension assemblies 238 and 239 for charge electrodes 230a and 230b, respectively, as well as tension assembly 240 for adjustably and simultaneously tensioning deflection electrode 231 and ground shield electrode 232. As indicated above, separate tension adjustment means are also provided for the ground electrode alone as described below and as shown in greater detail in FIGS. 9 and 10.

Tension assembly 240 is rigidly mounted to cross support 236 by virtue of support arm 242a and mounting bracket 242b and includes adjusting bolt 243 slidably received in slot 242c of support arm 242a, as well as adjustable compression spring 248 which exerts a bias force against mounting arm 235. Adjusting bolt 243 and nut 244 are threadably engaged with one another to thereby permit the bias force exerted upon mounting arm 235 to be selectively adjustable depending upon the turning movement applied to adjusting bolt 243. As in the previous embodiment, the bias force exerted upon arm 235 causes the mounting arm to be pivotally moved outwardly away from its opposing rigidly fixed mounting arm, thereby maintaining both the deflection and ground electrodes in a tensioned state between the two arms.

FIG. 8 of the drawings depicts the mounting and tensioning means for the deflection and ground electrodes in greater detail. This particular embodiment of the tension assembly utilizes somewhat different means for causing lateral movement of the mounting arms in an outwardly direction during the mounting and simultaneous tensioning of the electrodes. Tension assembly 240 in FIG. 8 is representative of the tension assemblies for all three electrodes and is shown rigidly secured to cross support member 236 through support arm 242a and operatively coupled to mounting arm 235. Tension assembly 240 includes cylindrical housing 245 open at one end and fixedly secured to mounting arm 235 by virtue of the key and slot arrangement shown at 245a. Compression spring 248 is disposed inside the cylindrical cavity formed in housing 245. In order to ensure that the lateral adjustment and tensioning of the deflection and charge electrodes through pivotably-movable mounting arm 235 occurs without displacement of the electrodes in a direction perpendicular to their longitudinal axis, tension assembly 240 also includes a cylindrical T-shaped bearing socket member 246 having lip portion 247 extending over the open ends of housing 245 and being coaxially mounted with respect to the cylindrical housing.

The T-shaped bearing socket member 246 contains a recessed coaxial socket 249 sized to receive the ball portion 250 of adjusting bolt 243. As the adjusting bolt is selectively turned, ball portion 250 engages the socket and exerts a bias force against spring 248 and mounting arm 235 in a uniform, lateral manner, thereby effectively precluding any displacement of the deflection and charge electrodes in a direction perpendicular to their longitudinal axis as the tensioning operation takes place.

In like manner, the tension assembly for charge electrode 230b shown in FIG. 8 includes compression spring 260 disposed within cylindrical housing 261. The same ball-and-socket assembly is employed wherein the ball portion 262 of adjusting bolt 265 engages socket 266 in T-shaped member 267 to exert a bias force against spring 260. FIG. 8 also shows the relative positions of deflection electrode 231, ground shield electrode 232 (aligned directly below the deflection electrode) and charge electrode 230*b*. As indicated above, for optimum effectiveness, ground electrode 232 should preferably be mounted between ¼" and 1" below deflection electrode 231. Both electrodes pass around mounting arm 235 to be adjustably secured to one side of the mounting arm in the manner discussed below with respect to FIGS. 9 and 10.

As in the previous embodiment, the tension assemblies shown in FIG. 8 maintain the charge, deflection and ground shield electrodes in a tensioned state between their respective pairs of mounting arms (while automatically compensating for any thermal relaxation of the electrode members which may occur during usage) by virtue of the outward biased displacement of pivotally mounted arm members relative to the opposing, immovably-fixed mounting arms.

Figure 10:
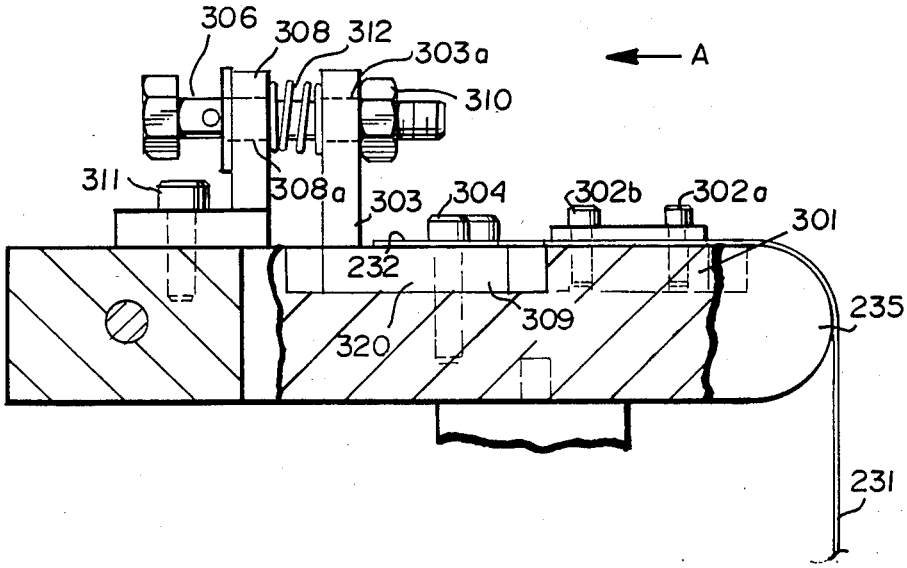
FIG. 10 is a detailed plan view, shown partially in cross-section, of the tension adjusting mechanism for deflection and ground electrodes employed in accordance with the invention.

FIGS. 9 and 10 of the drawings depict the separate tension assembly (shown generally as 300) for independently adjusting the tensioned state of the ground electrode after it is mounted below the deflection electrode on the pair of mounting arms and has been initially positioned and tensioned as described above.

As FIG. 10 indicates, both deflection electrode 231 and ground electrode 232 are wrapped around mounting arm 235 and are adjustably secured to one side by virtue of a mounting bracket and one or more mounting bolts for each electrode. Deflection electrode 231 is secured along the top, side portion of mounting arm 235 using bracket 301 and mounting bolts 302*a* and 302*b*, while ground shield electrode 232 is mounted in a lower, side position on mounting arm 235 using adjustable, slidably mounted L-shaped mounting bracket 303 and mounting bolt 304. Deflection electrode mounting bracket 301 is disposed in slot 320 in the side of mounting arm 235 and is tightened into position (thereby securing the deflection electrode) by engaging the end portions of mounting bolts 302*a* and 302*b* against the bottom surface of slot 320. The ground electrode is secured to adjustable mounting bracket 303 by bolt 304 which threadably engages mounting arm 235. An elliptical-shaped opening 309 (for receiving bolt 304) in bracket 303 allows the bracket to move forwardly and rearwardly beneath mounting bolt 304 (which is tightened to an extent to permit such movement) during the tensioning operation.

Ground electrode tension assembly 300 also includes a separate adjusting bolt 306 which is operatively coupled to L-shaped mounting bracket 303 by a threaded bolt assembly. Adjusting bolt 306 is slidably received in slots defined in mounting bracket 303 and opposing L-shaped bracket 308 via slots 303*a* and 308*a*. Thus, the two L-shaped brackets are positioned in a confronting and spaced relation to one another. L-shaped bracket 308 is fixedly secured to the side of mounting arm 235 by virtue of mounting bolt 311 while L-shaped bracket 303 slidably engages recessed slot 320 in the side of mounting arm 235. Adjusting bolt 306 and nut 310 are threadably engaged with one another such that the selective turning of bolt 306 causes a bias force to be exerted upon slidably mounted bracket 303 (overcoming the oppositely-directed force of compression spring 312) to forceably urge mounting bracket 303 in the direction depicted by arrow "A".

Thus, in order to independently adjust the tension on ground shield electrode 232 after it has been initially secured between the pair of mounting arms, adjusting bolt 306 is selectively turned thereby producing a bias force which urges the slidably mounted L-shaped bracket (and ground electrode 232) in a rearwardly direction relative to the front of mounting arm 235.

As will be apparent, the present invention may take the form of various modifications to the presently preferred exemplary embodiment disclosed herein, which modifications shall be accorded the broadest scope of the appended claims so as to encompass all equivalent structures, assemblies and/or devices.

What is claimed is:

1. An electrode structure for use in a fluid jet marking apparatus of the type having means to generate at least one linear array of fluid droplet streams, means for charging selected ones of said droplets in said streams, and means for electrostatically deflecting said selected charged droplets towards a droplet catching structure, wherein said electrode structure comprises (a) said means for charging selected ones of said fluid droplets; (b) said means for deflecting selected charged droplets; and (c) ground electrode means, said ground electrode means including:

a flexible and tensionable ground electrode member; and mounting means for mounting said ground electrode member in substantially parallel alignment to said linear array of fluid droplet streams and in substantially confronting alignment to said droplet catching structure, said mounting means including;

(a) a pair of mounting arms in spaced-apart relationship, said pair of mounting arms for mounting respective end portions of said ground electrode member therebetween, one of said pair being rigid and the other one of said pair being pivotal;

(b) first tensioning means connected to said other pivotal one of said pair of mounting arms for pivotally displacing said pivotal one relative to said rigid one to initially tension said ground electrode member between said pair of mounting arms; and (c) second tensioning means connected to said pivotal mounting arm and to one end of said ground electrode member to further tension said electrode member between said pair of mounting arms.

2. An electrode structure as in claim 1 wherein said ground electrode member is mounted directly below and in substantially parallel alignment with said defecting means at a distance of between ¼" and 1" below said deflecting means.

3. An electrode structure as in claim 1 wherein said first tensioning means comprises a force adjustable compression spring operatively connected to said pivotal mounting arm and to tension adjusting means, said tension adjusting means being selectively adjustable to exert a bias force on said spring and said pivotal mounting arm.

4. An electrode structure as in claim 3 wherein said tension adjusting means includes an adjusting bolt having a ball configuration at one end thereof and being operatively connected to bearing socket means mounted in coaxial alignment with said compression spring.

5. An electrode structure as in claim 1 wherein said second tensioning means comprises an adjustable mounting bracket connected to one end of said ground electrode member, a force adjustable compression spring operatively connected to said mounting bracket, and tension adjusting means being selectively adjustable to exert a bias force on said spring and said mounting bracket.

6. An electrode structure as in claim 1 further comprising a cross-support member to mount said pair of mounting arms in said spaced-apart relationship.

7. An electrode structure as in claim 1 wherein said means for deflecting said charged droplets and said ground electrode means are mounted to said mounting means for said ground electrode.

8. An electrode structure as in claim 1 wherein said flexible and tensionable ground electrode member consists of electrically conductive ribbon.

9. An electrode structure as in claim 1 wherein said flexible and tensionable ground electrode member consists of electrically conductive wire.

10. A ground electrode for use in a fluid jet marking apparatus of the type having means to generate at least one linear array of fluid droplet streams, means for charging selected ones of said droplets in said streams and means for electrostatically deflecting said selected charged droplets towards a droplet catching structure, said ground electrode comprising a flexible and tensionable electrode member; and mounting means for mounting said ground electrode member, said mounting means comprising (a) a pair of mounting arms in spaced-apart relationship, said pair of mounting arms for mounting respective end portions of said ground electrode member therebetween, one of said pair being rigid and the other one of said pair being pivotal;

(b) first tensioning means connected to said other pivotal one of said pair of mounting arms for pivotally displacing said other pivotal one relative to said rigid one to initially tension said ground electrode member between said pair of mounting arms; and (c) second tensioning means connected to said pivotal one of said mounting arms and to one end of said ground electrode member to further tension said electrode member between said pair of mounting arms.

11. A ground electrode as in claim 10 wherein said first tensioning means comprises a force adjustable compression spring operatively connected to said pivotal mounting arm and to tension adjusting means, said tension adjusting means being selectively adjustable to exert a bias force on said spring and said pivotal mounting arm.

12. A ground electrode as in claim 10 wherein said second tensioning means comprises an adjustable mounting bracket connected to one end of said ground electrode member, a force adjustable compression spring operatively connected to said mounting bracket, and tension adjusting means being selectively adjustable to exert a bias force on said spring and said mounting bracket.

13. A ground electrode as in claim 10 further comprising a cross-support member to mount said pair of mounting arms in said spaced-apart relationship.

14. A ground electrode as in claim 10 wherein said flexible and tensionable electrode member consists of electrically conductive ribbon.

15. A ground electrode as in claim 10 wherein said flexible and tensionable electrode member consist of electrically conductive wire.

16. A fluid-jet marking apparatus of the type having means for generating at least on linear array of fluid droplet streams, charge means for charging selected ones of said droplets, a droplet catcher for catching said charged selected ones of said droplets, deflection for deflecting said charged selected ones of said droplets towards said catcher and away from ground electrode means, wherein said ground electrode means includes:

a flexible and tensionable ground electrode member; and mounting means for mounting said ground electrode member is substantially parallel alignment to the linear array of fluid droplet streams and in substantially confronting alignment to said droplet catcher, said mounting means including;

(a) a pair of mounting arms in spaced-apart relationship, said pair of mounting arms for mounting respective end portions of said ground electrode member therebetween, one of said pair being rigid and the other one of said pair being pivotal;

(b) first tensioning means connected to said other pivotal one of said pair of mounting arms for pivotally displacing said pivotal one relative to said rigid one to initially tension said ground electrode member between said pair of mounting arms; and (c) second tensioning means connected to said pivotal mounting arm and to one end of said ground electrode member to further tension said electrode member between said pair of mounting arms.

17. A fluid-jet marking apparatus as in claim 16 wherein said ground electrode member is mounted directly below and in substantially parallel alignment with said defecting means at a distance of between ¼" and 1" below said deflecting means.

18. A fluid-jet marking apparatus as in claim 16 wherein said first tensioning means comprises a force adjustable compression spring operatively connected to said pivotal mounting arm and to tension adjusting means, said tension adjusting means being selectively adjustable to exert a bias force on said spring and said pivotal mounting arm.

19. A fluid-jet marking apparatus as in claim 16 wherein said tension adjusting means includes an adjusting bolt having a ball configuration at one end thereof and being operatively connected to bearing socket means mounted in coaxial alignment with said compression spring.

20. A fluid-jet marking apparatus as in claim 16 wherein said second tensioning means comprises an adjustable mounting bracket connected to one end of said ground electrode member, a force adjustable compression spring operatively connected to said mounting bracket, and tension adjusting means being selectively adjustable to exert a bias force on said spring and said mounting bracket.

21. A fluid-jet marking apparatus as in claim 16 further comprising a cross-support member to mount said pair of mounting arms in said spaced-apart relationship.

22. A fluid-jet marking apparatus as in claim 16 wherein said means for deflecting said charged droplets and said ground electrode means are mounted to said mounting means for said ground electrode.

23. A fluid-jet marking apparatus as in claim 16 wherein said flexible and tensionable electrode member consists of electrically conductive ribbon.

24. A fluid-jet marking apparatus as in claim 16 wherein said flexible and tensionable electrode member consists of electrically conductive wire.

25. An electrode assembly for a fluid jet marking apparatus of the type which generates at least one linear array of fluid droplet streams, said electrode assembly comprising a flexible and tensionable electrode, and mounting means for mounting said electrode under tension laterally of and substantially parallel to the at least one linear array of fluid droplet streams generated by means of the fluid jet marking apparatus, said electrode thereby establishing an electrode mounting plane, wherein said mounting means includes:

(i) a pair of spaced-apart mounting arms each having a forward end;

(ii) said electrode being mounted between said arms and having end portions in contact with a respective said forward end of said arms;

(iii) at least one end portion of said electrode being wrapped at least partially around said respective forward end of one of said arms so as to extend in a lateral direction relative to said established electrode mounting plane;

(iv) a mounting bracket connected to said at least one end portion of said electrode and coupled to said one of said arms for movements in said lateral direction relative to said established electrode mounting plane; and (v) tensioning means operatively associated with said mounting bracket for exerting a bias force on said bracket in said lateral direction relative to said established electrode mounting plane, which bias force, in turn, tensions said electrode between said pair of mounting arms within said electrode mounting plane.

26. An electrode assembly as in claim 25 wherein said one of said arms is pivotal and the other of said arms is rigid, and wherein said mounting means further includes another tensioning means for pivotally displacing said one arm relative to said other arm, whereby said electrode is tensioned by said first-mentioned and said another tensioning means.

27. An electrode assembly as in claim 25 wherein said mounting bracket includes a pair of L-shaped brackets positioned in confronting relationship to one another, one of said brackets being slidably coupled to said one arm for movements in said lateral direction, while the other of said brackets is rigidly coupled to said one arm, and wherein said tensioning means is operatively connected to said one and other brackets.

28. An electrode assembly as in claim 27, wherein said one bracket defines an elongate slot and includes a mounting bolt disposed in said slot for mounting said one electrode end to said one bracket, said elongate slot permitting said one bracket to be slideably moved in said lateral direction.

29. An electrode assembly as in claim 27, wherein said tensioning means includes turnable adjusting means coupled to said one and other brackets for moving said one bracket relative to said other bracket in response to selective turning movements thereof and for translating said selective turning movements into said lateral directional movements of said one bracket.

30. An electrode assembly as in claim 29, wherein said tensioning means further includes spring means associated with said adjusting means for urging said one and other brackets in a direction tending to separate the same.

* * * * *